US011198981B2

(12) United States Patent
Cofano et al.

(10) Patent No.: US 11,198,981 B2
(45) Date of Patent: Dec. 14, 2021

(54) PROTECTION DEVICE AND ROAD BARRIER FOR MOTORCYCLISTS

(71) Applicant: ARCELORMITTAL, Luxembourg (LU)

(72) Inventors: Claudia Cofano, Liege (BE); Michael Gremling, Seraing (BE)

(73) Assignee: ArcelorMittal, Luxembourg (LU)

( * ) Notice: Subject to any disclaimer, the term of this patent is extended or adjusted under 35 U.S.C. 154(b) by 30 days.

(21) Appl. No.: 16/757,917

(22) PCT Filed: Dec. 11, 2018

(86) PCT No.: PCT/IB2018/059853

§ 371 (c)(1),
(2) Date: Apr. 21, 2020

(87) PCT Pub. No.: WO2019/116211

PCT Pub. Date: Jun. 20, 2019

(65) Prior Publication Data

US 2020/0340195 A1 Oct. 29, 2020

(30) Foreign Application Priority Data

Dec. 11, 2017 (WO) ..... PCT/IB2017/001537

(51) Int. Cl.
*E01F 15/04* (2006.01)
*E01F 8/00* (2006.01)
(Continued)

(52) U.S. Cl.
CPC ..... *E01F 15/043* (2013.01); *E01F 8/0023* (2013.01); *E01F 15/146* (2013.01); *E01F 8/007* (2013.01); *E01F 15/085* (2013.01)

(58) Field of Classification Search
CPC ..... E01F 8/0023; E01F 15/043; E01F 15/146; E01F 15/085
See application file for complete search history.

(56) References Cited

U.S. PATENT DOCUMENTS 2,228,652 A * 1/1941 Dailey ..... E01F 15/0438 256/13.1
3,450,233 A * 6/1969 Massa ..... E01F 15/0438 188/374
(Continued)

FOREIGN PATENT DOCUMENTS

AT 294900 B 12/1971
EP 0969149 A2 1/2000
(Continued)

OTHER PUBLICATIONS

See International Search Report of PCT/IB2018/059853, dated May 4, 2019.

*Primary Examiner* — Daniel J Wiley
(74) *Attorney, Agent, or Firm* — Davidson, Davidson & Kappel, LLC

(57) ABSTRACT

A protection device (5*a*) for motorcyclists, adapted to be secured to a road safety barrier (1) with a plurality of poles (3) regularly spaced out, the protection device (5*a*) including a longitudinal beam (6*a*) and a spacer (7*a*) extending longitudinally alongside the rear side of at least one part of the beam (6*a*) and adapted to be secured to the poles, wherein the beam (6*a*) and the spacer (7*a*) are assembled together so as to define, in the part of the beam, a longitudinal damping volume (V) with a closed cross-section.

31 Claims, 4 Drawing Sheets

(51) Int. Cl.
*E01F 15/14* (2006.01)
*E01F 15/08* (2006.01)

(56) References Cited

U.S. PATENT DOCUMENTS 3,617,076 A * 11/1971 Attwood ..... F16B 5/0685 403/395
5,069,576 A * 12/1991 Pomero ..... E01F 15/0423 404/6
5,876,020 A * 3/1999 Giavotto ..... E01F 15/0423 256/13.1
6,860,676 B2 3/2005 Pont Feixes
8,517,349 B1 * 8/2013 Ross ..... E01F 15/143 256/13.1

FOREIGN PATENT DOCUMENTS

EP 1566486 A1 * 8/2005 ..... E01F 15/0461
EP 2450489 A2 5/2012
FR 2861106 A1 4/2005

* cited by examiner

PROTECTION DEVICE AND ROAD BARRIER FOR MOTORCYCLISTS

The invention is in the field of road barriers installed on roadsides and/or highway sides.

The invention refers more particularly to a protection device for motorcyclists adapted to be installed on a road barrier, in order to better protect motorcyclists who would collide with the barrier.

BACKGROUND

Road barriers are well known and comprise at least one longitudinal metallic rail, kept at a distance from the ground by a plurality of poles set in roadsides and spaced out regularly. These barriers form smooth retention devices which deform themselves in the event of an impact with a vehicle. Part of the energy from the impact is then absorbed during the deformation of the barrier, therefore limiting the damage to the vehicle exiting the road.

However, these barriers are only efficient for motor vehicles. Indeed, taking into account the gap existing between the rail and the ground, motorcyclists who fall and are projected towards the barrier risk colliding with the poles. Yet, the significant impact caused by this collision with the poles of the barrier almost always causes serious injuries to the motorcyclists involved.

The document EP2450489 discloses a protection system for motorcyclists, adapted to be secured to the road safety barrier. The protection system comprises a beam extending longitudinally between the rail and the ground to protect the rider from poles. This beam is kept at a distance from the poles by a plurality of anchoring means, each anchoring means being secured to a pole and extending in the direction of the pole axis.

SUMMARY OF THE INVENTION

However, the deformation of the EP 2450489 protection system in the event of an impact has such a strong amplitude, that the motorcyclist still risks colliding with poles of the road safety barrier despite the protection system.

It is an object of the present invention to provide a protection device for motorcyclists, adapted to be secured to the road safety barrier, and adapted to protect motorcyclists from the poles of the road barrier at all times while efficiently containing them/slowing them down.

For this purpose, the protection device for motorcyclists is adapted to be secured to a road safety barrier with a plurality of poles regularly spaced out and comprises a longitudinal beam and a spacer extending longitudinally all along the rear side of at least one part of said beam and adapted to be secured to said poles, wherein the beam and the spacer are assembled together so as to define, in said part of the beam, a longitudinal damping volume with a closed cross-section, so as to spread the strain along the device in the event of an impact to limit the transversal deformation of the beam and to maintain it at a distance from the poles of the road barrier. The spacer comprises a central fastening section to said poles from which extend two legs respectively superior and inferior whose open ends are fastened to the beam, the inferior leg and the superior leg being at an angle $\alpha$ comprised between 60° and 100° and the inferior leg and the central fastening section being at an angle $\beta$ comprised between 105° and 145°.

The protection device for motorcyclists of the present invention may also include the following optional characteristics considered individually or according to all possible combination of techniques:

The spacer presents such length that it may be secured to at least two adjacent poles of the road barrier The longitudinal damping volume is of a polygonal closed cross-section.

The ratio $S/(H \times W)$ is superior or equal to 0.2, where S is the surface of the transversal cross-section of the damping volume, H the height of the beam and W the width of the beam.

The superior leg and the central fastening section are at an angle $\gamma$ comprised between 105° and 165°.

Each open end of the two legs comprise a bracket for the beam.

The longitudinal damping volume is formed by the beam and by the legs and the fastening section to the poles of the spacer.

The beam comprises a planar central section prolonged by two end parts forming fastening sections to the spacer.

The protection device further comprises at least one stabilizing member comprising a central planar section and two end portions adapted to be fixed respectively to one of the poles and to the beam, so as to stabilize the positions of the beam on the barrier.

The stabilizing member is a U-shaped plate.

The invention is to also provide a road safety barrier comprising a longitudinal rail secured to a plurality of poles set in the ground and regularly spaced out, and which is essentially characterised in that it comprises a protection device for motorcyclists as described above.

The road safety barrier of the invention may also comprise the following optional characteristics considered individually or according to all possible combination of techniques:

The beam of the protection device comprises a central section that is inclined relative to a pole axis and transversally extends away from said axis as it reaches closer to the ground.

The beam of the protection device comprises two end portions in the prolongation of the inclined section and forming respectively both a superior fastening section and an inferior fastening section to the spacer.

The inferior fastening section comprises a flap adapted to lay on the ground.

The superior fastening section of the beam forms an angle with the inclined section so that the superior fastening section is parallel to the pole axis.

The superior fastening section of the beam is located in the same plane as the inclined section so that the superior fastening section is also inclined relative to the pole axis.

The central section of the beam is inclined relative to the poles axis at an angle of 10° to 25°, preferably 10° to 20°.

The protection device comprises at least one stabilizing member formed by a third profiled sheet comprising a central planar section and two end portions adapted to be fixed respectively to one of the poles and to the beam, so as to stabilize the position of the beam on the barrier.

The stabilizing member is a U-shaped plate.

At least one end portion of the stabilizing member is secured to the beam at the level of the superior fastening section of the beam.

The protection device is secured to each pole by fastening means.

The fastening means comprise at least two fastening assemblies respectively superior and inferior, so that the superior assembly encloses the poles while being fixed to the stabilizing member, and so that the inferior assembly encloses the pole while being fixed to the spacer.

Each fastening assembly comprises at least two bolts extending on both side of the pole so the first bolt ends are secured respectively to the stabilizing member and to the spacer, and so the respective second bolt ends are secured to superior connecting plates and inferior connecting coming to rest against the back side of the pole opposite to the protection device.

Each fastening assembly comprises adjusting means for the spacing between the bolts and the poles, said adjusting means being arranged in the connecting plates and respectively in the fastening section to the pole of the spacer and in the first fastening portion of the stabilizing member to allow for the bolts to be positioned as close as possible to the edges of the pole during the fastening of the protection device to the poles.

The superior adjusting means comprise a series of openings arranged in the first fastening portion of the stabilizing member, the openings being spaced out regularly and horizontally, and elongated hole arranged in the superior connecting plate and whose major axis extends parallel to the longitudinal axis of the connecting plate.

The inferior adjusting means comprise a series of openings 281 arranged in the central fastening section 13 of the spacer 7*a,* 7*b,* the openings 281 being spaced out regularly and horizontally, and an elongated hole 271 arranged in the inferior connecting plate 241 and whose major axis extends parallel to the longitudinal axis of the connecting plate.

The invention is to also provide a protection kit for the assembling of a protection device for motorcyclist, adapted to be secured to a road safety barrier with a plurality of poles regularly spaced out, the kit comprising a first profiled sheet forming a longitudinal beam, a second profiled sheet forming a spacer, wherein the beam and the spacer are adapted to be assembled together, with the spacer extending longitudinally all along the rear side of said beam, so as to define a longitudinal damping volume with a closed cross-section, wherein the spacer comprises a central fastening section to said poles from which extend two legs respectively superior and inferior whose open ends are adapted to be fastened to the beam, the inferior leg and the superior leg being at an angle $\alpha$ comprised between 60° and 100° and the inferior leg and the central fastening section being at an angle $\beta$ comprised between 105° and 145°.

The kit of the invention may also comprise the following optional characteristics considered individually or according to all possible combination of techniques:

- The kit comprises a plurality of first profiled sheets adapted to be arranged end to end in order to form the longitudinal beam.
- The kit comprises a plurality of elements adapted to be arranged end to end in order to form the spacer.
- The kit comprises a plurality of stabilizing members each formed by a third profiled sheet and adapted to stabilize the positions of the beam on the barrier.
- The kit comprises fastening means for fastening the beam and the spacer to the barrier.

BRIEF DESCRIPTION OF THE DRAWINGS

Other characteristics and advantages of the invention will be apparent in the below descriptions, by way of indication and in no way limiting, and referring to the annexed figures among which.

DETAILED DESCRIPTION

First, it is noted that on the figures, the same references designate the same elements regardless of the figure on which they feature and regardless of the form of these elements. Similarly, should elements not be specifically referenced on one of the figures, their references may be easily found by referring oneself to another figure.

It is also noted that the figures represent mainly two embodiments of the object of the invention but other embodiments which correspond to the definition of the invention may exist.

It is well known that road barriers include a usually metallic rail extending longitudinally, that is parallel to the ground. This rail is secured to poles set in the ground and regularly spaced out, so that the rail is kept at a distance from the ground.

It is also known to integrate to this type of road barrier a system of protection for motorcyclists, comprising a beam longitudinally extending and secured to the poles of the barrier by means of a plurality of anchoring means, each anchoring means being secured to a pole of the barrier and extending in the direction of the pole axis. Such a protection system presents a deformation of strong amplitude in the event of an impact, which will not always stop the motorcyclist from colliding with the poles of the barrier in the event of a fall. The present invention provides a protection device 5*a,* 5*a′,* 5*b* for motorcyclists adapted to be secured to a road barrier, which in the event of an impact presents a deformation of sufficiently low amplitude to remain at a distance from the poles at all times. The motorcyclist who will then hit the protection device 5*a,* 5*a′,* 5*b* of the invention following a fall will not collide with the poles of the barrier.

Figure 1:
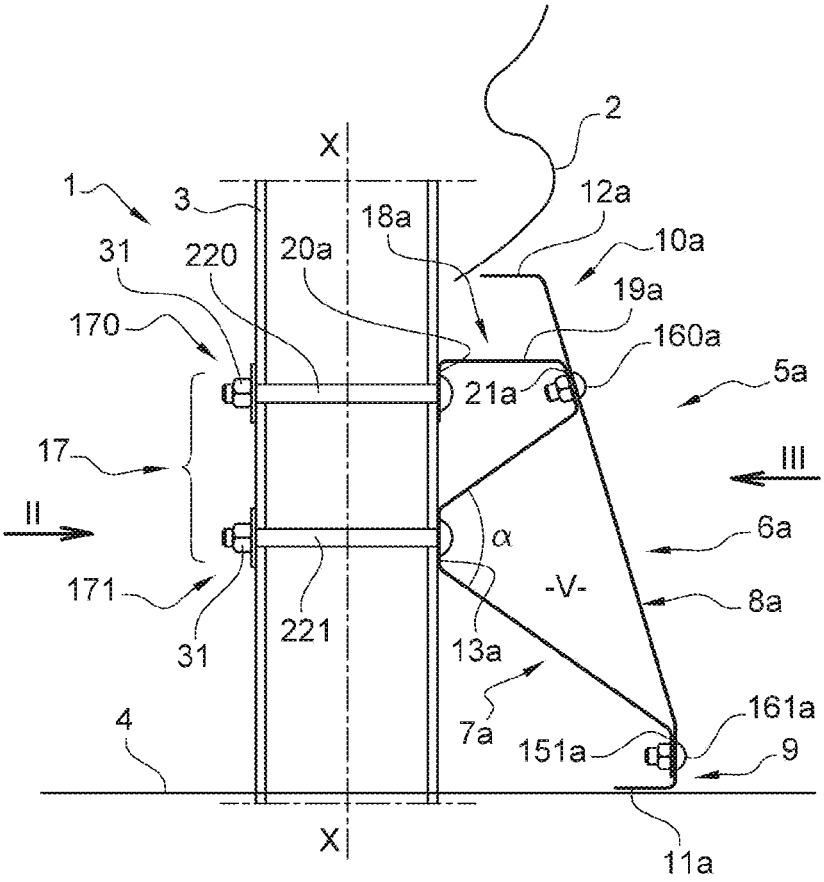
FIG. 1 is a sectional view of the protection device according to one embodiment secured to a pole of a road barrier.

Referring to FIG. 1 and as previously indicated, the road barrier 1 comprises a longitudinal metallic rail 2 (partially illustrated), with a W-shaped cross-section for example. The barrier 1 further comprises a plurality of poles 3 set in the ground 4 and regularly spaced out, the poles 3 being all parallel to each other. Each pole 3 thus extends perpendicularly to the rail 2 according to a pole axis X-X. In the rest of this description, the term "vertical" will be used to designate the pole axis and more generally all direction perpendicular to the ground 4, and the term "horizontal" will be used for the elements of barrier 1 which extend longitudinally, that is parallel to ground 4.

Referring to FIGS. 1 to 4, the road barrier 1 comprises a protection device 5*a* for motorcyclists according to a first embodiment.

The protection device 5*a* comprises a longitudinal beam 6*a*, thus extending itself horizontally and which is secured to the poles 3 of the barrier 1 by means of a longitudinal spacer 7*a*. This spacer 7*a* has the function of maintaining the beam 6*a* at a distance from the poles 3 at all times, particularly by absorbing more efficiently the impact energy as will be showed in more details later. Thanks to the longitudinal beam 6*a* and to the longitudinal spacer 7*a*, the beam 6*a* stays sufficiently distant from the poles 3 of the road barrier to protect motorcyclists from these poles 3 at all times while efficiently containing them and/or slowing them down, even in the event of a violent impact caused by a motorcyclist colliding with the beam 6*a* and generating an important transversal deformation of beam 6*a*.

The spacer 7*a* extends horizontally along one part of the beam 6*a*, preferably on more than 50% of the beam, more preferably on more than 70% of the beam and even more preferably all along the beam 6*a*. The spacer 7*a* extends over the pole 3, preferably extends of at least one meter on both sides of the pole 3.

The beam 6*a* and the spacer 7*a* are formed respectively by first and second profiled metallic sheets, preferably obtained by roll-forming or bending. The steel constituting the first and second sheets presents preferably an average elastic limit of approximately 260 MPa, a great resistance to impacts and an elongation at break of at least 26%. The steel thus also presents a good resistance to corrosion. For this purpose, the steel preferably comprises a Magnelis® type metallic coating produced in a hot-dip galvanising line in a molten bath comprising 2.5-3.5% in magnesium and 3-4% in aluminium.

The beam 6*a* comprises a central planar section 8 prolonged by two end parts 9*a*, 10*a* (see e.g. FIG. 3), forming fastening sections to the spacer 7*a*, respectively inferior (lower) fastening section 9*a* and superior (upper) fastening section 10*a*. The central section 8*a* is inclined relative to the pole axis X-X, at an angle of 10° to 25°, preferably 10° to 20°, more preferably of 16°. The beam 6*a* transversally extends itself away from the pole axis X-X as it reaches closer to the ground 4. In other words, the inferior section of the beam 6*a*, corresponding to the inferior fastening section 9*a* which is the closest to the ground 4, is further away from the poles 3 then the superior section of said beam 6*a*, forming the superior fastening section 10*a* located in front of the rail 2. The central section 8 being planar, its deformation during impact is homogeneous in its height and stiffened areas and/or preferential deformations in weak points are avoided. This helps absorbing the energy from the impact. In particular, it doesn't comprise any inward bend as the bend could project the motorcyclist in the air towards the longitudinal rail 2 of the road safety barrier.

The inferior fastening section 9*a* of the beam 6*a* further preferably comprises a flap 11*a* to enable it to lay on the ground 4. Thanks to that, the protection device 5*a* is more stable. In addition, there are no space between the ground and the beam 6*a*, preventing a sliding rider from coming into contact with any potential hazard that may be behind the beam 6*a*. As illustrated in FIG. 1, the inferior fastening section 9*a* is bent at an angle of 90°. As the flap 11 *a* is horizontal, the inferior fastening section 9 thus extends itself vertically towards the central inclined section 8*a* of the beam 6*a*. The flap 11*a* is not fastened to the ground so that the deformation during impact is not prevented.

The superior fastening section 10*a* also preferably comprises a flap 12*a* whose open end engages the rail 2. This flap 12*a* thus ensures continuity between the rail 2 and the protection device 5*a*. As illustrated in FIG. 1, the superior fastening section 10*a* is bent at an obtuse angle. The flap 12*a* is horizontal and the superior fastening section 10*a* extends itself beyond the bend towards the central inclined section in the same plane as the latter.

The spacer 7*a* is from a sectional view generally V-shaped, and comprises a central section 13*a* of fastening to the poles 3 from which extend two legs respectively superior 140*a* and inferior 141*a* (see, e.g., FIG. 4) towards and to the inner surface 32*a* of the beam 6*a*. The superior leg 140*a* and the inferior leg 141*a* are inclined above and below a horizontal axis parallel to the road. Particularly, the inferior leg 141*a* and the central fastening section 13 are at an angle β of 105° to 145°, preferably of 115° to 135°. Particularly, the superior leg 140*a* and the central fastening section 13 are at an angle γ of 105° to 165°, preferably of 115° to 135°. Particularly, both legs 140*a*, 141*a*, are at an angle α of 60° to 90°, preferably of 70°. The central fastening section 13*a* ensures the securing of spacer 7*a* to the poles 3 by fastening means 17 described further below. The central section 13*a* is thus preferably planar.

The V-shaped spacer 7*a*, thanks to the inclination of both inferior 140*a* and superior 141*a* legs as defined above and thanks to the value of the angles α, β and γ, produces a deformation of said legs 140*a*, 141*a* in the event of an impact of a motorcyclist against the beam 6*a*, said deformation leads to an increase of the spacing between the legs 140*a*, 141*a*. The deformation not only absorbs the energy from the said impact but also generates a spring effect which pushes back the rider who hit the beam 6*a* away from the poles 3. In other words, the beam 6*a* and the spacer 7*a* work in synergy in case of impact on the protection device 5*a* to dampen the transversal stresses. In particular, the inferior leg 141*a* being oriented below the horizontal plane, it doesn't prevent the protection device from absorbing the impact of the motorcyclist sliding along the horizontal plane.

Both the superior leg 140*a* and the inferior leg 141*a* of the spacer 7*a* extend from the central fastening section 13*a* towards an open end forming respectively the superior bracket 150*a* and inferior bracket 151*a* to the beam 6*a*. More specifically, both the superior bracket 150*a* and inferior bracket 151*a* are maintained in contact with the inner surface 32*a* of the beam 6*a* respectively at the level of the superior fastening section 10*a* and of the inferior fastening section 9*a* of the beam 6*a*. The superior bracket 150*a* and inferior bracket 151*a* are preferably fasten respectively to the superior fastening section 10*a* and to the inferior fastening section 9*a* by bolts 160*a*, 161*a* (see., e.g., FIG. 1). In addition, the bolts 160*a*, 161*a* are preferably regularly spaced in the longitudinal direction of the beam 6*a*, the space between two bolts 16*a*0, 161*a*, respectively at the level of the superior bracket 150*a* and at the level of the inferior bracket 151*a*, being around one meter. Thanks to this value of spacing between two successive bolts 160*a*, 161*a*, overall stability of the fastening between the beam 6*a* and the spacer 7*a* is increased.

Figure 2:
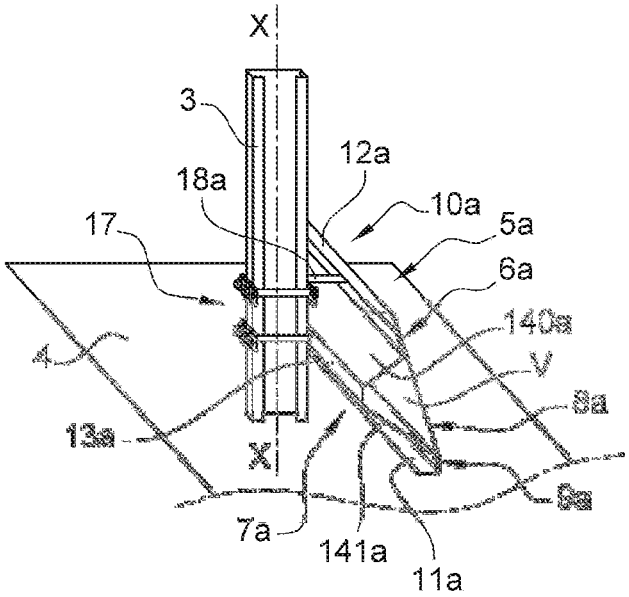
FIG. 2 is a perspective back view of the barrier from FIG. 1 according to arrow II, illustrating particularly the damping volume formed by the beam and the spacer.

As shown in FIG. 2, the beam 6*a* and the spacer 7*a* thus define a damping volume V which extends longitudinally, that is horizontally, along the beam 6*a*. More specifically, the sides of this damping volume V are defined by the central fastening section 13*a* and the two legs 140*a*, 141*a* of spacer 7*a*, and by the inclined central section 8*a* of the beam 6*a*. In transversal cross-section, the corresponding surface, i.e. defined by the central fastening section 13*a* and the two legs 140*a*, 141*a* of spacer 7*a*, and by the inclined central section 8*a* of the beam 6*a*, is identified as the damping surface S (see FIG. 4). Thanks to the damping volume V and the corresponding damping surface S, the forces generated by the impact on the protection device 5*a* are well distributed along the sides of the damping volume V. As a result, the absorption of the impact energy in the protection device 5*a* is homogenous and wide, which in turn reduces the amplitude of the transversal deformation of the beam 6*a*. Particularly, the ratio S/(H×W) where S is the damping surface, H the height of the beam 6*a* (measured along the vertical axis) and W the width of the beam 6*a* (measured along the horizontal axis) is superior or equal to 0.2, more preferably comprised between 0.2 and 0.4. This improves even further the distribution of the forces generated by the impact on the protection device 5*a*. As a result, the absorption of the impact energy in the protection device 5*a* is more homogenous and wider.

In the particular embodiment for which the spacer 7*a* extends all along the beam 6*a*, the spacer 7*a*, in the event of an impact, distributes the forces generated by the impact on the protection device 5*a* (along the sides of the damping volume V) to a large longitudinal extent. As a result, the absorption of the impact energy in the device 5*a* is even more homogenous and wider, which in turn reduces the amplitude of the transversal deformation of the beam 6*a*.

Figure 3:
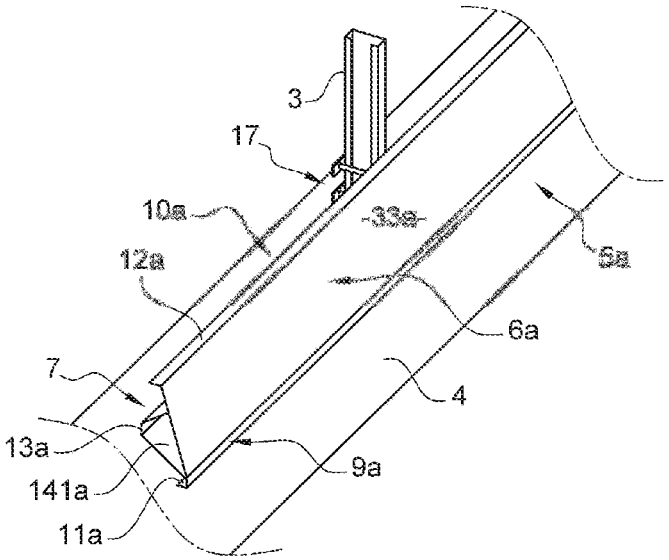
FIG. 3 is a perspective front view of the barrier from FIG. 1 according to arrow III, representing specifically the side of the beam opposite to the pole of the road barrier.

Referring to FIGS. 1 to 3, the protection device 5*a* of the first embodiment according to a first particular example preferably comprises at least one stabilizing member 18*a* formed by a third sheet, preferably obtained by roll-forming or bending. The said stabilizing member 18*a* preferably has the same mechanical characteristics than those of the primary and secondary sheets 6*a*, 7*a*.

The stabilizing member 18*a* provides a second fastening point of the beam 6*a* to the pole 3, thus stabilizing the position of the beam 6*a* in the event of an impact:

- By preventing any rotation of the beam 6*a* around an axis passing through the fastening points of the beam 6*a* on the central fastening section 13*a* of the spacer 7*a*, and
- By maintaining the spacing from the superior fastening section 10*a* of the beam 6*a* to the poles 3, ensuring the continuity between the rail 2 and the beam 6*a*.

The stabilizing member 18*a* has a U-shaped transversal cross-section presenting:

- a central planar section 19*a* extending horizontally between a pole 3 and the inner surface 32*a* of the beam 6*a* and
- two end portions forming respectively the first fastening portion 20*a* to the pole 3 and the second fastening portion 21*a* facing the inner surface 32*a* of the beam 6*a* at the level of its superior fastening section 10*a*.

The second fastening portion 21*a* preferably faces at the same time the inner surface 32*a* of the beam 6*a* at the level of its superior fastening section 10*a* and the superior bracket 150*a* of the spacer 7*a*. The second fastening portion 21*a* of the stabilizing member 18*a*, the superior bracket 150*a* of the spacer 7*a* and the superior fastening section 10*a* of the beam 6*a* are thus superimposed and secured together by common securing means, for example a bolt 160*a*.

Particularly, the first fastening portion 20*a* of the stabilizing member 18*a* is secured to pole 3 by fastening means 17.

The stabilizing member 18*a* is bent at 90° between the central planar section 19*a* and the first fastening portion 20*a*, the latter being parallel to the given vertical pole 3, and bent at an obtuse angle between the central planar section 19*a* and the second fastening portion 21*a*, the latter being parallel to the inclined central portion 8*a* of the beam 6*a*. The second portion of fastening 21*a* of the stabilizing member 18*a* is thus disposed to rest against the inner surface 32*a* of the beam 6*a* at the level of its superior fastening section 10*a*.

The U-shaped stabilizing member 18*a* provides an easy installation of the beam 6*a* on the different types of existing poles 3 of road barriers 1.

There can be as many stabilizing members 18*a* of the beam 6*a* as they are poles 3. These stabilizing members 18*a* allow the stabilization of the protection device 5*a*, as well as maintaining the flap 12*a* of the superior fastening section 10*a* of the beam 6*a* at a constant distance from the poles 3, particularly when the beam 6*a* is deformed during an impact.

Figure 5:
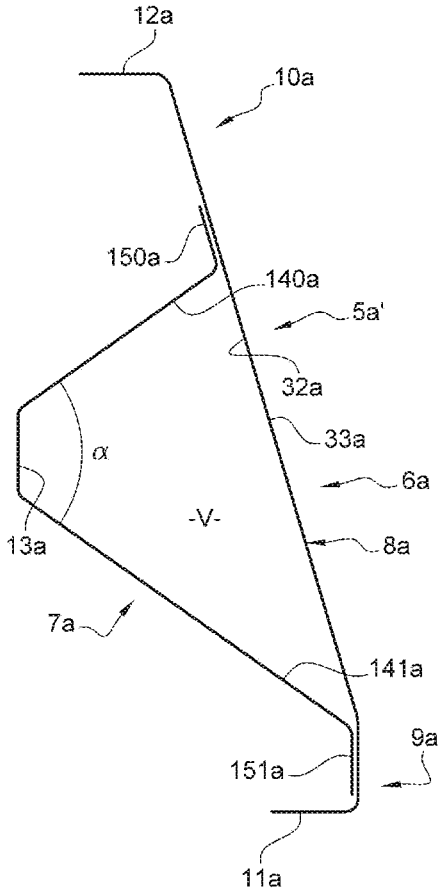
FIG. 5 is a sectional view of the protection device of FIG. 4 without the stabilizing member.

According to a second particular example of the first embodiment illustrated on FIG. 5, spacer 7*a* and beam 6*a* are the same than those described above. The damping volume V is thus the same and damping effect is identical. The second particular example does not comprise any stabilizing member, which has no effect on damping since said damping effect is provided by the spacer 7 combined with the beam 6*a*. The device 5*a'* of this second example is a bit less stable when set to the barrier 1 than the device 5*a* of the first example of the first embodiment.

Figure 6:
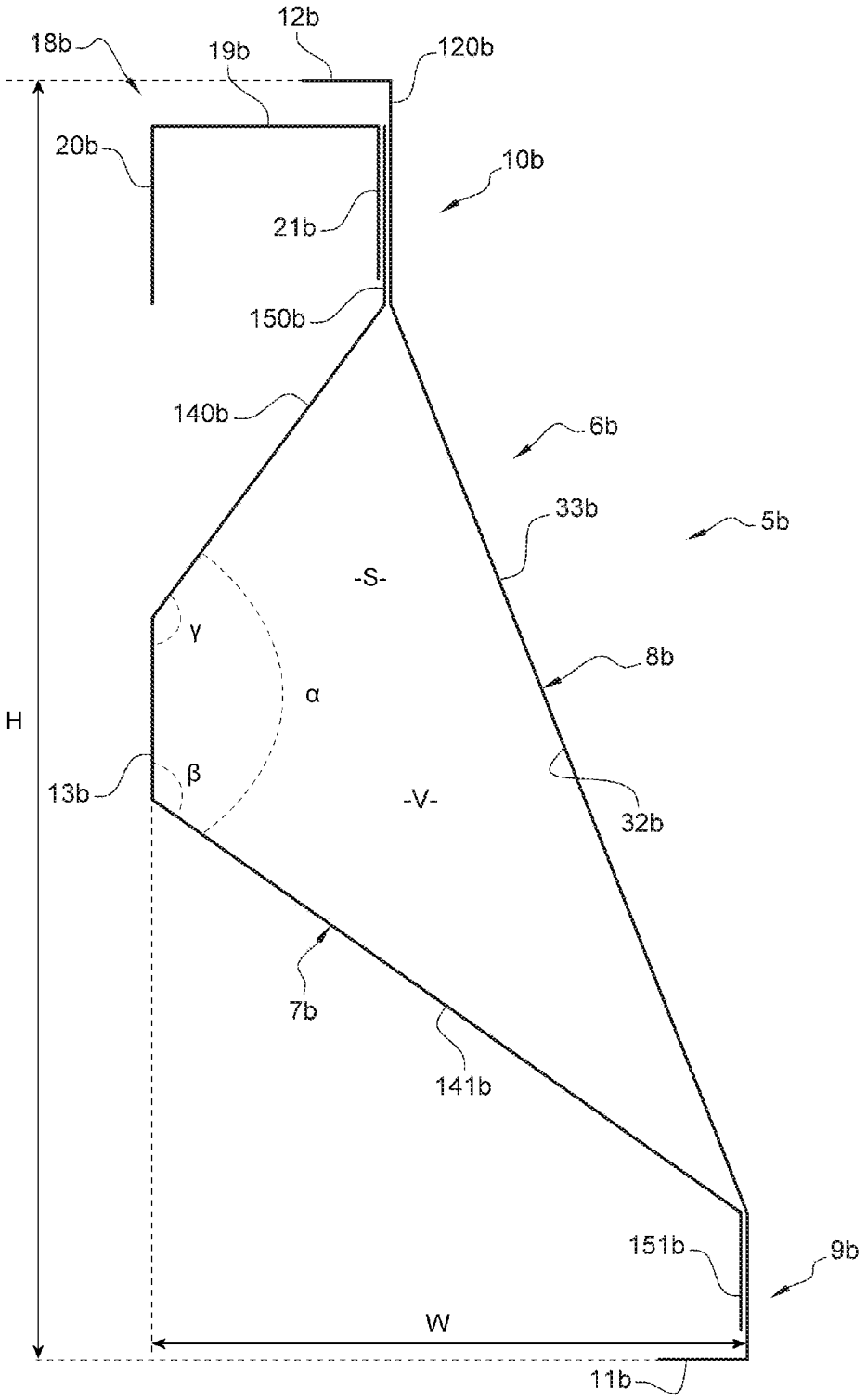
FIG. 6 is a sectional view of the protection device according to another embodiment.

Referring to FIG. 6, the protection in a second embodiment is almost identical to the protection device 5*a* in the first embodiment, except for the superior fastening section 10*b* of the beam 6*b* which presents a different configuration and for the angle α between the legs 140*b*, 141*b*.

Indeed, the superior fastening section 10*b* of the beam 6*b* is now bent at 90° so that the flap 12*b* is horizontal and superior fastening section 10*b* extends beyond the bend by a vertical portion 120*b*. In this embodiment of the invention, the vertical portion 120*b* and the inclined central portion 8 thus extend themselves into two different planes.

Thus, the junction line between the superior fastening section 10*b* and the central part 8*b* of the beam 6*b* is closer to the poles 3 in this second embodiment. As a result, the inclination of the central section 8*b* is more marked. In particular, to compensate for this change in inclination of the beam 6*b*, the superior leg 140*b* and inferior leg 141*b* form an angle α superior to the one of the first embodiment. Particularly, both legs 140*b* and 141*b* are at an angle α of 70° to 100°, preferably around 90°. In particular, the angle β between the inferior leg and the central fastening section has the same value than in the first embodiment. Accordingly, the superior leg and the central fastening section form an angle γ inferior to the one of the first embodiment. The ratio S/(H×W) is still superior or equal to 0.2, more preferably comprised between 0.2 and 0.4.

The stabilizing member 18*b* of this second embodiment of the device 5*b* also has a slightly different configuration. Indeed, the stabilizing member 18*b* is bent at 90° between the central planar section 19*b* and the second fastening portion 21*b* to conform to the verticality of the superior fastening section 10*b* of the beam 6*b*. The second fastening portion 21*b* is thus parallel to the given pole 3.

In this second embodiment of the protection device 5*b*, owing to the vertical orientation of the superior fastening section 10*b* of the beam 6*b* and of the second fastening portion 21*b* of the stabilizing member 18*b*, the position of the beam 6*b* on the barrier 1 is better stabilized.

Figure 4:
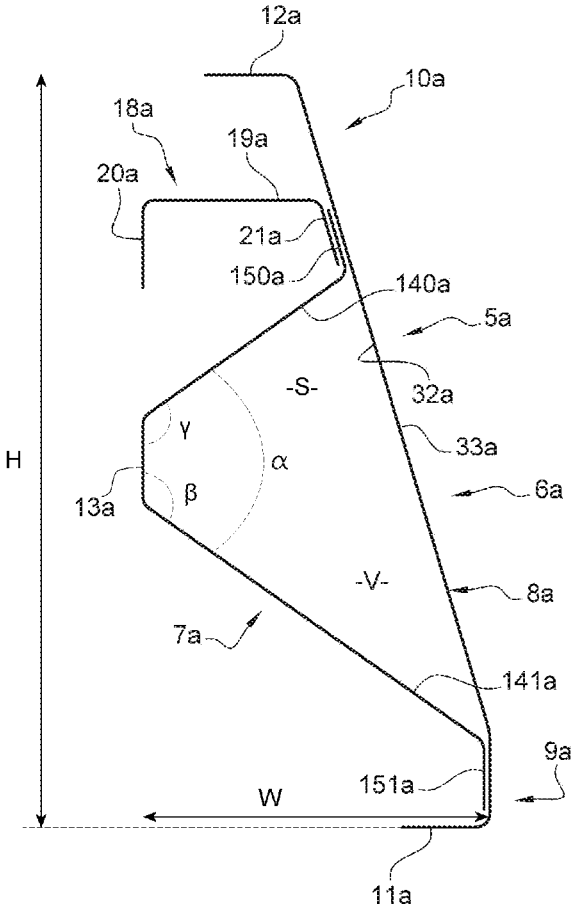
FIG. 4 is a sectional view of the protection device according to a first embodiment including a stabilizing member.

Regarding FIGS. 4 to 6, it can be assumed that the protection device 5*a*, 5*a'*, 5*b* is included in a trapezoidal shape, in which the larger base length is of 180 to 220 mm, preferably of 200 mm, in which the smaller base is of 60 to 100 mm, preferably of 80 mm, and in which the height of such trapezoidal shape is of 400 to 450 mm, preferably of 430 mm.

The length of the smaller base represents the distance between the pole 3 and the edge of the superior fastening section 10*a*, 10*b* which is adjacent to the central section 8*a*, 8*b*. The length of the smaller base corresponds to the thickness of the rail 2, so that the superior fastening section 10*a*, 10*b* is in the continuity of the rail 2. The length of the larger base represents the distance between a pole 3 and the inferior fastening section 9*a*, 9*b*, and is chosen large enough to ensure that a rider will never collide with the pole 3 in case of an accident. Finally, the height of the protection device 5*a*, 5*a'*, 5*b* is chosen so that the open end of the flap 12*a*, 12*b* engages the rail 2. The flap 12*a*, 12*b* thus ensures continuity between the rail 2 and the protection device 5*a*, 5*a'*, 5*b*.

Figure 7:
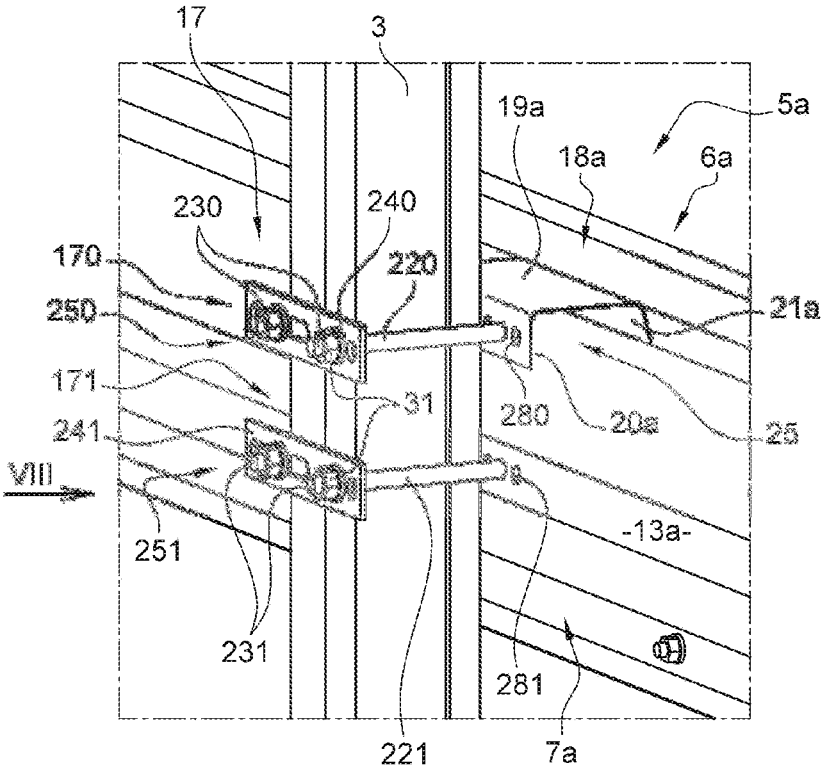
FIG. 7 is a perspective back view representing the fastening means of the protection device of FIGS. 1 to 3 to the pole.
Figure 8:
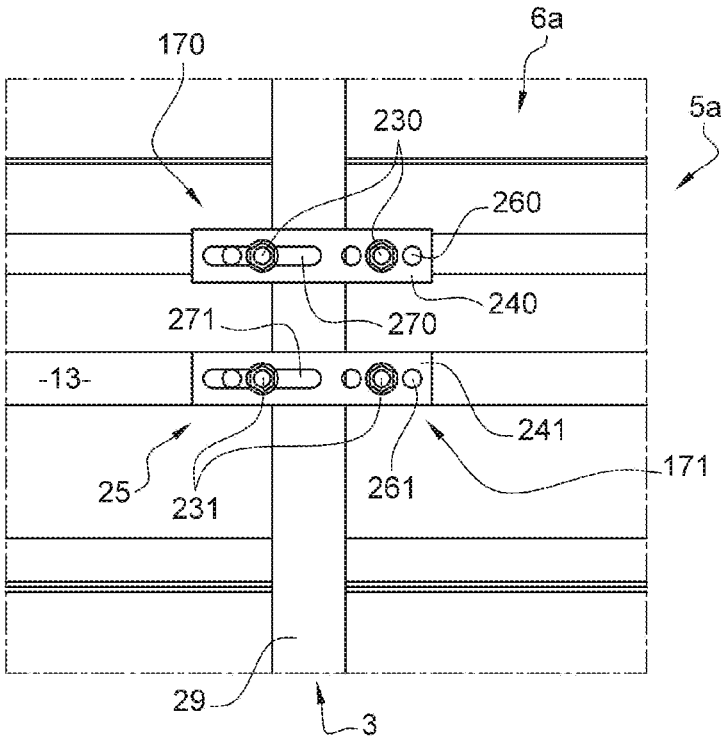
FIG. 8 is a longitudinal back view of the protection device from FIG. 5 according to arrow VIII, detailing how the spacing between the bolts of the fastening means can be adapted to the pole.

Referring to FIGS. 7 and 8, the fastening means 17 of the protection device 5*a*, 5*b* to the barrier 1 comprise for each pole 3 two assemblies respectively superior 170 and inferior 171.

The superior assembly 170 comprises a superior connecting plate 240 and two superior threaded bolts 220, and the inferior assembly 171 comprises an inferior connecting plate 241 and two inferior threaded bolts 221. The bolts 220, 221 of both assemblies 170, 171 extend on either side of the given pole 3. The superior assembly 240 is adapted to fix the stabilizing member 18*a* to the pole 3 whilst the inferior assembly 221 is adapted to fix the spacer 7 to the same pole 3.

The bolts 220 of the superior assembly 170 comprise first ends (not represented) passing through openings 280 arranged in the first fastening portion 20*a* of the considered stabilizing member 18*a*, and second ends 230 passing through openings 260, 270 arranged in the superior connecting plate 240. The superior connecting plate is against the back side 29 of the pole 3, that is the surface 29 opposite to the protection device 5*a*, 5*b*. The superior bolts 220, the superior connecting plate 240 and the stabilizing member 18*a* are then bolted together preferably by tightening nuts 31 so that the superior assembly 170 encloses the pole 3.

Similarly, the first ends of the inferior bolts 221 of the inferior assembly 171 pass through openings 281 arranged in the central fastening section 13*a*, 13*b* of the spacer 7*a*, 7*b*, and the second ends 231 of the bolts 221 pass through openings 261, 271 arranged in the inferior connecting plate 241. The connecting plate 241 of the inferior assembly 171 is also against the back side 29 of the pole 3. The inferior bolts 221, the inferior connecting plate 24 and the spacer 7*a*, 7*b* are then bolted together preferably by tightening nuts 31 so that the superior assembly 170 encloses the pole 3.

Finally, to better adjust the spacing of the bolts 220, 221 to a given pole 3, the fastening means 17 comprise adjusting means 25 of such spacing. Referring to FIGS. 7 and 8, these adjusting means 25 comprise superior and inferior adjusting means, respectively 250 and 251.

The superior adjusting means 250 comprise:

- a series of openings 280 arranged in the first fastening portion 20*a* of the stabilizing member 18*a*, 18*b*, the openings 280 being spaced out regularly and horizontally (and thus perpendicularly to the pole axis X-X), and
- an elongated hole 270 arranged in the superior connecting plate 240 and whose major axis extends parallel to the longitudinal axis of the connecting plate 240.

The inferior adjusting means 251 comprise:

- a series of openings 281 arranged in the central fastening section 13*a*, 13*b* of the spacer 7*a*, 7*b*, the openings 281 being spaced out regularly and horizontally (and thus perpendicularly to the pole axis X-X), and
- an elongated hole 271 arranged in the inferior connecting plate 241 and whose major axis extends parallel to the longitudinal axis of the connecting plate 241.

These adjusting means 25 thus allow to reposition the bolts 220 and 221 as close as possible to the edges of a given pole 3 during the fastening of the protection device 5*a*, 5*b* to the poles 3. In addition, this succession of openings 280, 281 and these elongated holes 270, 271 allow the fastening of the protection device with adjusting means 25 to any kind of pole 3 or existing barrier. There is thus as many fastening means 17 as there are poles 3 to the road barrier 1.

Naturally, the adjusting means 25 remain equivalent when they comprise on the one hand elongated holes arranged respectively in the fastening section 13*a*, 13*b* and the first fastening portion 20*a*, 20*b* of the stabilizing member 18*a*, 18*b*, and on the other hand, a series of holes arranged in the considered connecting plate 240, 241 and regularly spaced out according to a direction parallel to the longitudinal axis of the said connecting plate 240, 241.

In the particular case of the protection device 5*a'* without stabilizing member 18*a*, the fastening means 17 of said protection device 5*a'* to the barrier 1 comprise for each pole 3 only the inferior assembly 171. Consequently, the adjusting means 25 only comprise the inferior adjusting means 251.

The protection device 5*a*, 5*a'* and 5*b* for motorcyclists according to the invention is therefore formed by at least two sheets (beam 6*a*, 6*b* and spacer 7) ensuring the damping and stabilization of said device 5*a*, 5*b*. Preferably, the protection device comprises a stabilizing member 18*a*, 18*b*. The protection device 5*a*, 5*b* is perfectly adapted to be secured by fastening means 17 to a road barrier with a rail 2 to form the road barrier 1 of the invention.

Virtual testing measures of the head impact criterion, known as the acronym HIC, were performed respectively with the devices 5*a* and 5*b* of the invention and with a device without a spacer, using a finite element method.

The HIC criterion is the parameter measuring the intensity of the impact against the motorcyclist's head. The HIC criterion is determined during crash tests, with mannequins projected against the road barrier 1, from acceleration data gathered by at least one accelerometer integrated at the level of the mannequin's head's gravity centre. Thus, the value reached by the HIC criterion is directly correlated to the gravity of wounds suffered by the motorcyclist colliding with the barrier 1.

More specifically, the HIC is calculated using the following formula:

$$HIC = \max_{t_1,t_2}\left[(t_2 - t_1)\left(\frac{1}{t_2 - t_1}\int_{t_1}^{t_2} a(t)dt\right)^{2,5}\right]$$

and evaluates the peak acceleration suffered by the motorcyclist's head during the period of time $t_2$-$t_1$. According to European standard EN 1317-8, concerning criteria to be applied when realizing crash test involving security barrier, it has been established that the HIC criterion reaches a value around 2700 for a road barrier 1 with only the rail 2 and the beam 6*a* (and thus without the spacer 7), when a 87.5 kilograms dummy hits such a road barrier near a pole, with an angle of 30 degrees relative to the longitudinal rail 2, at a 70 km/h speed. Such a value will trigger the motorcyclist's death in 90% of cases.

These virtual HIC values of the device of the invention have been obtained by performing four different tests regarding EN 1317-8 standard with a spacer 7*a*, 7*b* extending all along the beam 6*a*, 6*b* of the devices 5*a* and 5*b*.

In the first test, a 87.5 kilograms dummy hit the longitudinal beam 6*a*, 6*b* of the road barrier 1 near a pole 3, with an angle of 30 degrees relative to the longitudinal rail 2, at a 70 km/h speed. The HIC value measured is 424.

In the second test, the 87.5 kilograms dummy hit the beam 6*a*, 6*b* of road barrier 1 between two poles 3, with an angle of 30 degrees relative to the longitudinal rail 2, at a 70 km/h speed. The distance between two poles is 4 meters. The HIC value measured is 153.

In the third test, the 87.5 kilograms dummy hit the longitudinal beam 6*a*, 6*b* of the road barrier 1 near a pole 3, with an angle of 30 degrees relative to the longitudinal rail 2, at a 60 km/h speed. The HIC value measured is 265.

Finally, in the fourth test, 87.5 kilograms dummy hit the beam 6*a*, 6*b* of road barrier 1 between two poles 3, with an angle of 30 degrees relative to the longitudinal rail 2, at a 60 km/h speed. The distance between two poles is 4 meters. The HIC value measured is 96, which is a particularly low value.

It is thus clear that with the device of the invention and owing to the capacities of spacer 7 to absorb a large part of the impact energy, the values of the HIC criterion decrease dramatically, only causing moderate wounds to the motorcyclist. This is particularly obvious at a 60 km/h speed impact between two poles 3.

Particularly, computer impact simulations using HIC parameters obtained from the crash tests described above demonstrate that when a motorcyclist collides with the protection device 5*a*, 5*b* of the invention, the beam 6*a*, 6*b* stays at a distance from the poles 3. Thus, owing to the damping of the impact by the spacer 7*a*, 7*b*, the beam 6*a*, 6*b* maintains itself efficiently at a distance from the poles 3, which prevents the motorcyclists colliding with the beam 6*a*, 6*b* from also hitting the poles 3 of barrier 1.

Thus, as well as efficiently absorbing the impact energy, the spacer maintains the beam at a distance from the poles.

The invention also relates to a protection kit adapted to be installed on a road security barrier 1. This kit comprises a plurality of profiled elements adapted to be arranged end to end in order to form the longitudinal beam 6*a*, 6*b* of the protection device. More precisely, at least one end portion of each profiled element is adapted to overlap the end portion of the adjacent element. The overlapping length is of 150 to 300 mm, preferably of 200 to 250 mm.

The kit also comprises a plurality of V-shaped profiled elements adapted to be arranged along the beam. When the spacer 7*a*, 7*b* is all along the beam 6*a*, 6*b*, then the V-shaped profiled elements are adapted to be arranged end to end. More precisely, at least one end portion of each V-shaped profiled element is adapted to overlap the end portion of the adjacent V-shaped element. The overlapping length is of 150 to 300 mm, preferably of 200 to 250 mm and more preferably of 230 mm.

In addition, the kit comprises the fastening means 17 described above, in order to allow fastening of the assembled beam 6*a*, 6*b* and spacer 7 forming the damping volume V to the barrier 1.

Finally, the kit may comprise a plurality of stabilizing members 18*a*, 18*b* described above.

What is claimed is:

1. A protection device for a motorcyclist, adapted to be secured to a road safety barrier with a plurality of poles regularly spaced out, the protection device comprising:

a longitudinal beam, wherein the beam is inclined relative to a pole axis of the poles, and wherein the beam includes upper and lower end parts; and a spacer extending longitudinally all along a rear side of the beam and adapted to be secured to a respective one of the poles, the beam and the spacer assembled together so as to define a longitudinal damping volume with a closed cross-section, wherein the spacer includes:

a central fastening section fastened to the poles, and a superior leg and an inferior leg extending from the central fastening section and each having an open end fastened to the upper and lower end parts of the beam, respectively, the inferior leg and the superior leg being at an angle a between 60° and 100° and the inferior leg and the central fastening section being at an angle B between 105° and 145°.

2. The protection device as recited in claim 1 wherein the spacer is configured with a length to be securable to at least two adjacent poles of the plurality of poles.

3. The protection device as recited in claim 1 wherein the longitudinal damping volume is of polygonal closed cross-section.

4. The protection device as recited in claim 1 wherein a ratio S/(H×W) is superior or equal to 0.2, where S is a transverse surface of the closed cross-section of the damping volume, H a height of the beam and W a width of the beam.

5. The protection device as recited in claim 1 wherein the superior leg and the central fastening section are at an angle γ between 105° and 165°.

6. The protection device as recited in claim 1 wherein each open end of the superior and inferior legs includes a bracket for the beam.

7. The protection device as recited in claim 1 wherein the longitudinal damping volume is formed by the beam and by the superior and inferior legs and the central fastening section.

8. The protection device as recited in claim 1 wherein the beam includes a planar central section prolonged by the upper and lower end parts forming fastening sections to the spacer.

9. The protection device as recited in claim 1 further comprising at least one stabilizing member including a central planar section and two end portions adapted to be fixed respectively to one of the poles and to the beam so as to stabilize a position of the beam on the barrier.

10. The protection device as recited in claim 9 wherein the stabilizer is a U-shaped plate.

11. A road safety barrier comprising: a longitudinal rail secured to a plurality of poles set in the ground and regularly spaced out; and the protection device as recited in claim 1.

12. The road safety barrier as recited in claim 11 wherein the beam of the protection device includes a central section which transversally extends away from the pole axis as the central section reaches closer to the ground.

13. The road safety barrier as recited in claim 12 wherein the upper and lower end parts in prolongation of the central section and defining, respectively, a superior fastening section and an inferior fastening section to the spacer.

14. The road safety barrier as recited in claim 13 wherein the inferior fastening section includes a flap configured to lay on the ground.

15. The road safety barrier as recited in claim 13 wherein the superior fastening section of the beam forms an angle with the inclined section so that the superior fastening section is parallel to the pole axis.

16. The road safety barrier as recited in claim 13 wherein the superior fastening section is in a same plane as the inclined section so that the superior fastening section is also inclined relative to the pole axis.

17. The road safety barrier as recited in claim 12 wherein the central section of the beam is inclined relative to the pole axis at an angle of 10° to 25°.

18. The road safety barrier as recited in claim 11 wherein the open ends of the spacer include a bracket for the beam at a level of end portions.

19. The road safety barrier as recited in claim 11 wherein the protection device includes at least one stabilizing member including a central planar section and two end portions configured to be fixed respectively to one of the poles and to the beam, so as to stabilize a position of the beam on the barrier.

20. The road safety barrier as recited in claim 19 wherein at least one of the two end portions of the stabilizing member is secured to a superior fastening section of the beam.

21. The road safety barrier as recited in claim 11 wherein the protection device is secured to each pole by a fastener.

22. The road safety barrier as recited in claim 21 wherein the fastener includes a superior assembly and an inferior assembly, the superior assembly enclosing one of the poles while being fixed to a stabilizing member and the inferior assembly enclosing the one pole while being fixed to the spacer.

23. The road safety barrier as recited in claim 22 wherein each of the superior and inferior assemblies includes at least two bolts extending on both sides of the pole so that first respective bolt ends are secured respectively to the stabilizing member and to the spacer, and so that second bolt ends are secured to superior connecting plates and inferior connecting plates coming to rest against a back side of the pole opposite to the protection device.

24. The road safety barrier as recited in claim 23 wherein each of the superior and inferior assemblies includes an adjuster for spacing between the bolts and the pole, the adjuster being arranged in the respective superior and inferior connecting plates and respectively in the fastening section of the spacer and in a first fastening portion of the stabilizing member to allow for the bolts to be positioned as close as possible to edges of the pole during fastening of the protection device to the poles.

25. The road safety barrier as recited in claim 23 wherein the adjuster of the superior assembly includes:

a series of openings arranged in the first fastening portion of the stabilizing member, the openings being spaced out regularly and horizontally; and an elongated hole arranged in the superior connecting plate and having a major axis extending parallel to the longitudinal axis of the superior connecting plate.

26. The road safety barrier as recited in claim 23 wherein the adjuster of the inferior assembly includes:

a series of openings arranged in the central fastening section of the spacer, the openings being spaced out regularly and horizontally; and an elongated hole arranged in the inferior connecting plate and having a major axis extends parallel to the longitudinal axis of the inferior connecting plate.

27. A kit for the assembling of a protection device for a motorcyclist, adapted to be secured to a road safety barrier with a plurality of poles regularly spaced out, the kit comprising:

a first profiled sheet forming a longitudinal beam, wherein the beam is inclined relative to a pole axis of the poles, and wherein the beam includes upper and lower end parts;

a second profiled sheet forming a spacer, the spacer extending longitudinally all along a rear side of the beam and adapted to be secured to a respective one of the poles wherein the beam and the spacer are adapted to be assembled together, so as to define a longitudinal damping volume with a closed cross-section, wherein the spacer includes a central fastening section fastened to the poles from which extend a superior and an inferior leg with open ends that are adapted to be fastened to the upper and lower end parts of the beam, respectively, the inferior leg and the superior leg being at an angle a between 60° and 100° and the inferior leg and the central fastening section being at an angle B between 105° and 145°.

28. The kit as recited in claim 27 further comprising at least one further first profiled sheet adapted to be arranged end to end with the first profiled sheet in order to define the longitudinal beam.

29. The kit as recited in claim 27 further comprising at least one further second profiled sheet adapted to be arranged end to end with the second profiled sheet in order to define the spacer.

30. The kit as recited in claim 27 further comprising a plurality of stabilizing members each formed by a third profiled sheet and adapted to stabilize a position[s] of the beam on the barrier.

31. The kit as recited in claim 27 further comprising at least one fastener for fastening the beam and the spacer to the barrier.

* * * * *